United States Patent [19]

Sando et al.

[11] Patent Number: 4,516,283

[45] Date of Patent: May 14, 1985

[54] METHOD FOR CONTINUOUS BLEACHING OF CLOTH

[75] Inventors: Yoshikazu Sando; Eiichi Nakano, both of Wakayama, Japan

[73] Assignee: Sando Iron Works Co. Ltd., Japan

[21] Appl. No.: 588,294

[22] Filed: Mar. 12, 1984

[30] Foreign Application Priority Data

Mar. 15, 1983 [JP] Japan ..... 58-42905

[51] Int. Cl.[3] ..... D06B 3/12

[52] U.S. Cl. ..... 8/149.1; 68/5 E

[58] Field of Search ..... 8/149.1, 111; 68/5 D, 68/5 E

[56] References Cited

U.S. PATENT DOCUMENTS

| | | | |
|---|---|---|---|
| 2,839,353 | 6/1958 | Coleman | 8/149.1 X |
| 3,370,911 | 2/1968 | Westall | 8/111 |
| 3,481,684 | 12/1969 | Sando et al. | 8/111 |
| 3,695,826 | 10/1972 | Meier-Windhorst | 8/149.1 X |
| 4,379,353 | 4/1983 | Holderer et al. | 8/111 X |

FOREIGN PATENT DOCUMENTS

| | | | |
|---|---|---|---|
| 2073266 | 10/1981 | United Kingdom | 68/5 E |

*Primary Examiner*—Philip R. Coe

*Attorney, Agent, or Firm*—McGlew and Tuttle

[57] ABSTRACT

A method for continuous bleaching of a cloth in a high pressure steamer with use of hydrogen peroxide, comprising soaking a cloth to be bleached with a neutral or slightly alkaline hydrogen peroxide solution outside the high pressure steamer body, squeezing the cloth, introducing the resultant cloth continuously in the steamer body maintained with wet-heat at a temperature above 100° C., and wet-heat treating the cloth therein while maintaining the total water content of the cloth to not less than 170% by applying hot water repeatedly to the cloth by using liquid apply means provided in the steamer body. A cotton cloth can uniformly and eminently be bleached in a short time continuously.

1 Claim, 1 Drawing Figure

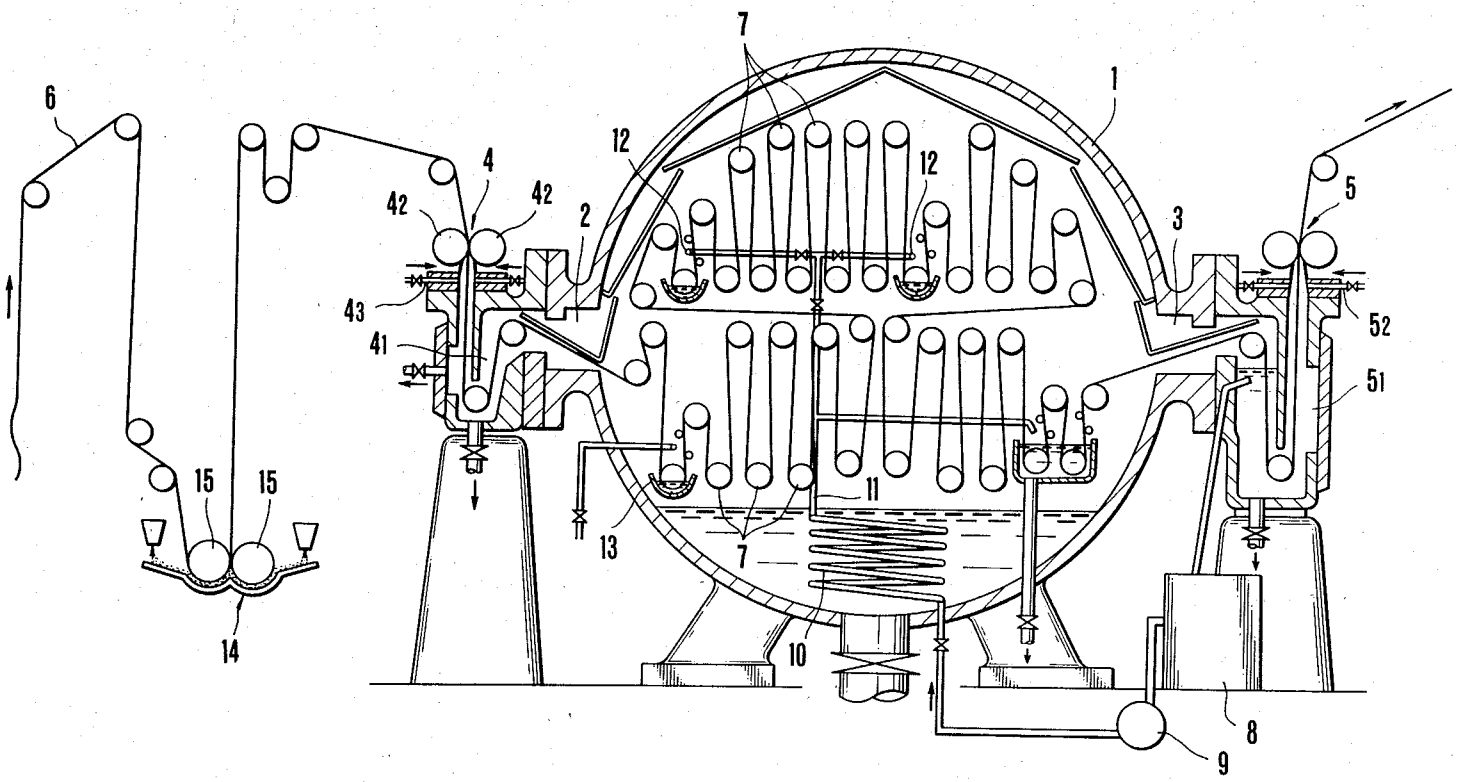
1
2
3
4
5
6
7
8
9
10
11
12
13
14
15
41
42
43
51
52

METHOD FOR CONTINUOUS BLEACHING OF CLOTH

BACKGROUND OF THE INVENTION

1. Field of the Invention

The present invention relates to a method for continuous bleaching of a cloth or particularly a cotton cloth by using a high pressure steamer.

2. Description of the Prior Art

In bleaching a cloth continuously using hydrogen peroxide, such processes have conventionally been adopted as to subject the cloth to wet-heat treatment for about 1 hour continuously by using a loading-type PERBLE RANGE (Trade Mark of a wet-heat treatment apparatus) or a J-box, to subject the cloth to steaming for 5 to 10 minutes in an ordinary pressure steamer body, and to utilize a rabit bleaching method. However, in any of these bleaching methods, while the whiteness can be satisfied as a whole, the removal of spots has been very difficult in the case when the raw cloth has numerous black or brown spots. For the removal of the spots, it has conventionally been adopted to subject the cloth repeatedly to alkaline scouring prior to bleaching or to repeat bleaching with use of concentrated hydrogen peroxide solution, but these processes have such defects that treating agent, heat energy and treating time are consumed in vain and the strength of the resultant cotton cloth is deteriorated.

In a loading-type wet-heat treatment by using PERBLE RANGE, in which steaming and boiling are made simultaneously, the above defects can be dissolved to some extent, but, in this instance, since the water content of the cloth (bath ratio) is low, soaking of the cloth with hydrogen peroxide solution must be repeated even when a concentrated treating solution is used.

SUMMARY OF THE INVENTION

Under such circumstances, the object of the present invention is to offer an eminent method for continuous bleaching of a cloth, particularly a cotton cloth with use of hydrogen peroxide solution in a high pressure steamer.

Essential points of the invention comprise soaking a cotton cloth with a neutral or alkaline hydrogen peroxide solution outside a high pressure steamer body, squeezing the cloth to an allowable water content, introducing the resultant cloth continuously in the steamer body maintained with wet-heat at a temperature above 100° C., and wet-heat treating the cloth therein while maintaining the total water content of the cloth to not less than 170% by applying hot water repeatedly to the cloth by using liquid apply means provided in the steamer body.

BRIEF EXPLANATION OF THE DRAWING

The drawing is an explanatory drawing showing an example of the apparatus to be used in the present inventive method for continuous bleaching of a cloth.

DETAILED DESCRIPTION OF THE INVENTION

The results of the experiments in bleaching of cotton cloth carried out by the present inventors will be described in the first place.

The raw cloth used for the bleaching was the one comprising a plane woven fabric with 52 pieces/inch of warps and 60 pieces/inch of wefts composed of cotton yarns with the yarn number of 20 and washed with hot water at 95° C. for 5 minutes. The raw cloth had 120 pieces/100 $cm^2$ of black or brown spots, and its whiteness was 55.2. The raw cloth was bleached under the following conditions by varying the concentration of hydrogen peroxide solution applied, and the result was as shown in Table 1.

Water content of the raw cloth: 70% (constant)

Wet-heat treatment:

Temperature-130° C. (steaming)

Time-60 seconds

Additive to the bleaching solution for controlling its pH: Sodium silicate 10 g/l+Caustic soda 5 g/l+Scourroll C 110 (made of Kawo Atlas) 1 g/l.

TABLE 1

| Bleaching Solution Concentration $H_2O_2$ (35%) g/l | Number of Spots per 100 $cm^2$ | Whiteness | $H_2O_2$ (OWF) % |
|---|---|---|---|
| 60 | 43 | 79.4 | 4.2 |
| 80 | 25 | 85.0 | 5.6 |
| 120 | 15 | 88.0 | 8.4 |
| 150 | 10 | 89.1 | 10.5 |
| 200 | 6 | 89.3 | 14.0 |

As obvious therefrom, it has proved that, even when a large excess of hydrogen peroxide is used with a concentration of 200 g/l (OWF 14.0%), while the whiteness is improved as a whole, spots are remained tolerably. Accordingly, it was tried to increase the water content of the raw cloth to 200%, and, as shown in Table 2, the number of spot could be reduced effectively. The raw cloth, wet-heat treatment conditions and the additive were the same as before.

TABLE 2

| Bleaching Solution Concentration $H^2O^2$ (35%) g/l | Number of Spots per 100 $cm^2$ | Whiteness | $H_2O_2$ (OWF) % |
|---|---|---|---|
| 10 | 12 | 72.3 | 2.0 |
| 20 | 2 | 85.8 | 4.0 |
| 30 | 2 | 89.0 | 6.0 |

It has proved in this way that the water content of the raw cloth at the time of wet-heat treatment has a large influence. Therefore, the water content of the raw cloth was varied in the range from 70% to 270% by maintaining the hydrogen peroxide concentration of the bleaching solution content as 30 g/l. The raw cloth, wet-heat treating conditions and the additive were the same as before, and the results obtained were as shown in Table 3.

TABLE 3

| Water Content % | Number of Spots per 100 $cm^2$ | Whiteness | $H_2O_2$ (OWF) % |
|---|---|---|---|
| 70 | 60 | 71.0 | 2.4 |
| 85 | 27 | 79.7 | 3.4 |
| 120 | 10 | 83.8 | 4.8 |
| 170 | 2 | 89.0 | 6.8 |
| 270 | 0 | 89.0 | 10.8 |

From the result, it is obvious that a bleached cloth having almost no spots and satisfactory whiteness can be produced when the water content of the raw cloth is not less than 170% (bath ratio 1:1.7).

Now, an example of the apparatus to be used in the present invention will be described with reference to the attached drawing hereinbelow.

In the drawing, 1 is a high pressure steamer body for bleaching a cottoh cloth provided with a cloth inlet 2 and a cloth outlet 3 having respectively an inlet side seal mechanism 4 and an outlet side seal mechanism 5 for maintaining the interior of the steamer body 1 with high pressure wet-heat at a temperature, for instance, between 100° and 130° C. The inlet side seal mechanism 4 comprises a nearly U-shaped passage $4_1$, a pair of seal rubber rolls $4_2$ for sealing the upper opening of the passage $4_1$ and a gas supply pipe $4_3$ for supplying a pressurized gas to the passage $4_1$. The outlet side seal mechanism 5 comprises a slow cooling tank $5_1$ and a cooling water supply pipe $5_2$ for passing water at the ordinary temperature or cooled through the slow cooling tank $5_1$ by controlling its temperature and amount so as to control the temperature of the cooling liquid to about 50° C. at the position near the outlet of the slow cooling tank $5_1$.

At the interior of the steamer body 1, a plurality of guide rolls 7 are provided for transporting a cotton cloth 6 to be bleached through the steamer body forming up and down snaky undulations. 8 is a filter for filtering the waste liquid exhausted from the slow cooling tank $5_1$, and the filtrate (cleansed liquid) coming from the filter 8 is heated up to the temperature of the interior of steamer body, say about 130° C. by passing through a heat exchanger 10, passed through a conduit 11 and blown onto the cloth passing through the steamer body 1 by means of nozzles 12 provided at suitable positions in the steamer body 1. The filter 8 may be any one which can separate such impurities as waste yarns coming from the cloth continuously from the waste liquid, for instance, the ones disclosed by the present inventors in Japanese Patent application Nos. Sho 54-164573, Sho 54-164574 and Sho 57-88471. 13 is a liquid apply tank provided in the vicinity of the cloth inlet 2 in the steamer body so as to supply a pH controlling solution (as will be described hereinafter) therein. 14 is a bleaching solution tank for soaking the cloth with a bleaching solution successively before the cloth is introduced in the steamer body 1, and 15 are a pair of squeeze rolls attached to the bleaching solution tank 14.

The construction of an example of the apparatus for the present inventive method is as described above. The present inventive method for continuous bleaching of a long cotton cloth by using said apparatus will then be described in the following.

At first, pressurized steam is blown into the interior of the steamer body 1, pressurized gas is supplied from the gas supply pipe $4_3$ through the passage $4_1$ provided in the inlet side seal mechanism 4, and cooling water is supplied from the water supply pipe $5_2$ into the slow cooling tank $5_1$ for maintaining the interior of the steamer body with high temperature saturated vapor at a temperature, for instance, about 130° C. On the other hand, a bleaching solution containing 60 g/l of 35% hydrogen peroxide solution is filled in the bleaching solution tank 14, and a pH controlling solution containing 20 g/l of sodium silicate, 10 g/l of caustic soda and 10 g/l of scourroll C 110 (made of Kawo Atlas) is supplied in the liquid apply tank 13.

Then, a long cotton cloth 6 to be bleached is passed through the bleaching solution tank 14 for soaking the cloth with the bleaching solution, squeezed by using the squeeze rolls 15 for controlling the water content of the cloth to an allowable content of 50 to 70%, and supplied continuously in the steamer body 1. The cloth supplied in the steamer body 1 is soaked immediately with the pH controlling solution in the liquid apply tank 13 and subjected to wet-heat treatment while receiving high temperature cleansed liquid successively from the nozzles 12 for maintaining the water content of the cloth to not less than 170%. Since the cloth 6 is wet-heat treated under the water content of not less than 170%, the cloth thus treated has a satisfactory whiteness but little spots.

The results of the experiments for determining the influence of temperature and time on the wet-heat treatment in the steamer body were as shown in Table 4. In this instance, the high temperature cleansed liquid was applied to the cloth successively so as to make the water content of the cloth to 170 to 250%.

TABLE 4

| Wet-heat Treatment | | Number of Spots | White- | $H_2O_2$ |
|---|---|---|---|---|
| Temp. °C. | Time min. | per 100 $cm^2$ | ness | (OWF) % |
| 100 | 1 | 58 | 59.6 | 4.2 |
| 100 | 5 | 7 | 79.8 | 4.2 |
| 100 | 10 | 2 | 89.1 | 4.2 |
| 110 | 0.5 | 17 | 78.3 | 4.2 |
| 110 | 1 | 8 | 83.7 | 4.2 |
| 110 | 2 | 5 | 84.9 | 4.2 |
| 120 | 0.5 | 15 | 78.7 | 4.2 |
| 120 | 1 | 5 | 85.9 | 4.2 |
| 120 | 2 | 2 | 87.0 | 4.2 |
| 130 | 5 | 8 | 86.3 | 4.2 |
| 130 | 1 | 1 | 89.1 | 4.2 |
| 130 | 2 | 0 | 89.1 | 4.2 |

As obvious from these experiments, a bleached cloth having almost no spot and satisfactory whiteness can be produced by soaking a cloth to be treated with an aqueous hydrogen peroxide solution, squeezing the cloth to an allowable water content of 50 to 70% and subjecting the resultant cloth to wet-heat treatment in the steamer body while applying hot alkaline water in the liquid apply tank thereto so as to make the total water content of the cloth to not less than 170%.

In this way, in carrying out the bleaching of a cloth continuously with use of hydrogen peroxide in a high pressure steamer, it is desirable that the amount of hydrogen peroxide (OWF) is 4 to 6% and the water content of the cloth is 170 to 270%. The pH of hydrogen peroxide solution applied to the cloth outside of the steamer body is desirably to be 7 to 11, and its pH is controlled with use of a pH controlling solution comprising, for instance, caustic soda, sodium silicate or a hydrogen peroxide stabilizer in the steamer body. The cloth soaked with such a hydrogen peroxide solution and squeezed to an allowable amount of 50 to 70%, i.e. to the amount which is not squeezed further in passing through the inlet side seal mechanism of the steamer body, is introduced in a high pressure steamer body maintained with vapor at a temperature in the range from 100° to 150° C., a pH controlling solution is applied to the cloth so as to make the water content of the cloth to 170 to 270%, and the cloth is wet-heat treated for 0.5 to 10 minutes (or desirably 0.5 to 2 minutes) to give a satisfactory result.

If an alkaline hydrogen peroxide solution can be applied to the cloth in the interior of the steamer body, it is easy to control the water content of the cloth in wet-heat treatment and also the apparatus can be simplified, but the decomposition of alkaline hydrogen peroxide solution proceeds violently as the temperature is elevated as in a high pressure steamer body, and for instance, its oxidizing force reduces to one third in 20 minutes at 100° C., 3 minutes at 115° C. and 1.5 minutes at 130° C., so that it is desirable that neutral or slightly alkaline hydrogen peroxide solution is applied to the cloth outside the steamer body and its pH is made into sufficiently alkaline in the steamer body.

What we claim:

1. A method for continuous bleaching of a cloth in a high pressure steamer with use of hydrogen peroxide, comprising soaking a cotton cloth to be bleached with a neutral or slightly alkaline hydrogen peroxide solution outside a high pressure steamer body, squeezing the cloth, introducing the resultant cloth continuously in the steamer body maintained with wet-heat at a temperature above 100° C., and wet-heat treating the cloth therein while maintaining the total water content of the cloth to not less than 170% by applying hot water repeatedly to the cloth.

* * * * *